United States Patent [19]

Ferm

[11] 4,410,419

[45] Oct. 18, 1983

[54] HEAT EXCHANGER ANTIFOULANT

[75] Inventor: Richard L. Ferm, Lafayette, Calif.

[73] Assignee: Chevron Research Company, San Francisco, Calif.

[21] Appl. No.: 398,129

[22] Filed: Jul. 14, 1982

[51] Int. Cl.[3] ..... C10G 9/16

[52] U.S. Cl. ..... 208/48 AA; 585/950; 252/51.5 A

[58] Field of Search ..... 208/48 AA; 252/51.5 A; 585/950

[56] References Cited

U.S. PATENT DOCUMENTS

| | | | |
|---|---|---|---|
| 3,312,620 | 4/1967 | Low et al. | 252/51.5 A |
| 3,364,130 | 1/1968 | Barnum et al. | 252/51.5 A |
| 3,666,656 | 5/1972 | Stanley | 208/48 AA |
| 3,776,835 | 12/1973 | Dvoracek | 208/48 AA |
| 3,894,958 | 7/1975 | McCoy et al. | 252/51.5 A |
| 4,280,916 | 7/1981 | Richards et al. | 252/51.5 A |

FOREIGN PATENT DOCUMENTS

| | | | |
|---|---|---|---|
| 2128113-Q | 5/1971 | France | 252/51.5 A |
| 5027047 | 3/1969 | Japan | 252/51.5 A |

*Primary Examiner*—Delbert E. Gantz
*Assistant Examiner*—Cynthia A. Prezlock
*Attorney, Agent, or Firm*—D. A. Newell; J. M. Whitney; J. J. DeYoung

[57] ABSTRACT

Disclosed is a process for reducing the fouling in a heat exchanger in which a hydrocarbon stream is heated or cooled as it passes through the heat exchanger. From 1 to 500 parts per million of a dialkyl fatty-acid amide is added to the stream to reduce fouling.

8 Claims, No Drawings

HEAT EXCHANGER ANTIFOULANT

BACKGROUND OF THE INVENTION

The invention relates to heat exchangers, particularly heat exchangers used in the processing of crude oil. More particularly, the invention relates to an additive for reducing heat exchanger fouling.

In the processing of petroleum, numerous heat exchangers are utilized to heat or cool process streams. Since refineries typically process very large quantities of petroleum ranging from 25,000 to 200,000 or more barrels per day, the heat exchangers in the refinery represent a very large capital investment. After a period of operation, deposits build up on the heat exchanger tubes greatly reducing heat exchanger efficiency and greatly increasing the energy consumed. Eventually, the heat exchanger must be taken out of operation and the tubes cleaned or replaced. Increasing heat exchanger efficiency and reducing the amount and rate of fouling can provide tremendous energy savings in refineries and other facilities that use heat exchangers.

DESCRIPTION OF THE PRIOR ART

Numerous nitrogen-containing heat exchanger antifoulant additives are well known in the art, for example, U.S. Pat. Nos. 3,271,295 and 3,271,296 which disclose various succinimides. U.S. Pat. No. 3,364,130 discloses amidoamines as heat exchanger antifoulants which are made by reacting chlorinated polybutenes with acrylic acid and then condensing with diethylenetriamine or tetraethylenepentamine. Similarly, U.S. Pat. No. 4,200,518 discloses the use of a polyalkyleneamine as a heat exchanger antifoulant additive.

SUMMARY OF THE INVENTION

A process for reducing heat exchanger fouling in which a liquid hydrocarbon stream is passed through a heat exchanger at a temperature from 0° to 1500° F. wherein from 1 to 500 parts per million of an antifoulant additive is added to said hydrocarbon stream, said additive comprising a dialkyl fatty acid amide of the formula:

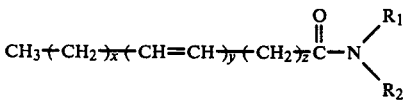

wherein

X and Z are independently integers from 0 to 12 and X+Z is at least 4,

Y is an integer from 0 to 3, and $R_1$ and $R_2$ are independently alkyl groups of 1 to 6 carbon atoms, or taken together with the amide nitrogen form a 5 to 6 membered heterocyclic ring.

DETAILED DESCRIPTION OF THE INVENTION

The heat exchangers utilized in the present invention are of any type where deposits accumulate on a heat transfer surface. The most common type of heat exchanger used is commonly known as a shell and tube heat exchanger.

The hydrocarbon stream passing through the heat exchanger is preferably a crude oil stream. Particularly preferred are petroleum stocks that contain reactive hydrocarbons such as olefins, sulfur, and nitrogen compounds. However, any hydrocarbon stream which leads to fouling of the heat exchanger can be utilized in the present invention, particularly various fractions of the crude oil. Generally, the streams passing through the heat exchanger will be heated or cooled at temperatures ranging from 0° to 1500° F., preferably 50° to 800° F.

The Dialkyl Fatty Amides

Any dialkyl fatty acid amides which prevent fouling can be used in the present invention. Dialkyl fatty acid amides which are useful in the present invention may be represented by the following structural formula:

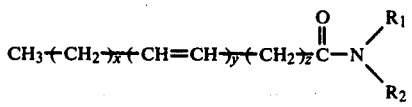

wherein X and Z are independently integers from 0 to 12 and X+Z is at least 4, Y is an integer of 0 to 3 and $R_1$ and $R_2$ are independently alkyl groups of 1 to 6 carbon atoms, or taken together with the amide nitrogen form a 5 or 6 membered heterocyclic ring. Preferably, X+Z is in the range of 8 to 20 and y is zero or 1 and $R_1$ and $R_2$ are methyl or ethyl. Most preferably $R_1$ and $R_2$ are methyl, X and Z are 3 to 8, and Y is 1.

Many of the dialkyl fatty amides described above are available commercially. They can also be made by the well known reaction of a fatty acid and a dialkyl amine. Examples of useful fatty acids include: hexanoic acid, lauric acid, palmitic acid and stearic acid. Unsaturated fatty acids can also be used such as oleic, and linoleic acid. Examples of useful dialkyl amines include: dimethyl amine, diethyl amine, methyl-ethyl amine, methylbutyl amine, piperidine and the like.

Most preferred for use in the present invention is N,N-dimethyl oleamide and N,N-dimethyl lauramide which can be made by reacting dimethyl amine with oleic acid and lauric acid, respectively.

To substantially reduce heat exchanger fouling, an effective amount, generally from 1 to 500 parts per million, preferably 5 to 99 parts per million, and most preferably 10 to 49 parts per million of the abovedescribed dialkyl fatty-acid amide is added to the stream passing through the heat exchanger. One surprising feature of the present invention resides in the finding that such small quantities of the above-described additive are effective in reducing heat exchanger fouling.

Examples 1-3—Antifouling Tests

Two dialkyl fatty-acid amides, N,N-dimethyl oleamide and N,N-dimethyl lauramide were tested for their antifouling characteristics using a standard ALCOR Test Apparatus. This test involves feeding a test stock material at a fixed rate and for a fixed period of time and at constant inlet temperature into a tube containing a stainless steel electrically heated rod while supplying enough heat to the rod to maintain the outlet temperature of the test stock constant. As fouling deposits form on the rod, the temperature of the rod must be increased to maintain a constant outlet temperature of the test stock. The initial rod temperature and final rod temperature are measured along with the initial and final weight of the rod. The increase in rod temperature and the amount of deposits on the rod are indicative of the degree and rate of fouling.

Each test run was for three hours and either no additive was used or 50 parts per million of additive was added to the test stock. The inlet temperature of the test stock was maintained at 70° F. and the outlet temperature was maintained at 500° F. The test stock was a Rangely Crude Oil. The results are shown below in the Table.

TABLE I

| Test No. | Test Base Stock and Additive | ΔT, °F. | Deposit Wt, mg |
|---|---|---|---|
| | Rangely Crude Oil | | |
| 1 | No Additive | 25 | 2.5 |
| 2 | N,N—dimethyl oleamide | 0 | 0.5 |
| 3 | N,N—dimethyl lauramide | −3 | 0.1 |

The above data indicates that the dialkyl amides of the present invention are highly effective as antifouling agents.

What is claimed is:

1. A process for reducing heat exchanger fouling in which a liquid hydrocarbon stream is passed through a heat exchanger at a temperature from 0° to 1500° F. wherein from 1 to 500 parts per million of an antifouling additive is added to said hydrocarbon stream, said additive comprising a dialkyl fatty amide of the formula:

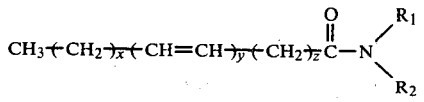

wherein:

X and Z are independently integers from 0 to 12 and X+Z is at least 4,

Y is an integer from 0 to 3, and $R_1$ and $R_2$ are independently alkyl groups of 1 to 6 carbon atoms, or taken together with the amide nitrogen form a 5 or 6 membered heterocyclic ring.

2. The process of claim 1 wherein said stream is crude oil or a fraction thereof.

3. The process of claim 1 wherein in said formula X+Y is in the range of 8 to 20, y is 0, and R is methyl or ethyl.

4. The process of claim 3 wherein said dialkyl fatty-acid amide is N,N-dimethyl oleamide.

5. The process of claim 3 wherein said dialkyl fatty-acid amide is N,N-dimethyl lauramide.

6. The process of claim 1 wherein 5 to 99 parts per million of said additive are added to said stream.

7. The process of claim 1 wherein said hydrocarbon stream is passed through said heat exchanger at a temperature from 50° to 800° F.

8. The process of claims 4 or 5 wherein said heat exchanger is a shell and tube heat exchanger.

* * * * *